US006000971A

United States Patent [19]

Hatagishi et al.

[11] Patent Number: 6,000,971

[45] Date of Patent: Dec. 14, 1999

[54] MULTI-STAGE CONNECTOR AND METHOD FOR PRODUCING AND ASSEMBLING THE SAME

[75] Inventors: Yuji Hatagishi; Toshiaki Okabe, both of Shizuoka, Japan

[73] Assignee: Yazaki Corporation, Tokyo, Japan

[21] Appl. No.: 08/922,589

[22] Filed: Sep. 3, 1997

[30] Foreign Application Priority Data

Sep. 3, 1996 [JP] Japan ..... 8-233315

[51] Int. Cl.[6] ..... H01R 13/514

[52] U.S. Cl. ..... 439/701

[58] Field of Search ..... 439/701, 398, 439/712, 717

[56] References Cited

U.S. PATENT DOCUMENTS

| | | | |
|---|---|---|---|
| 4,629,279 | 12/1986 | Nishikawa | 339/210 |
| 5,122,077 | 6/1992 | Maejima et al. | 439/398 |
| 5,839,922 | 11/1998 | Orlando et al. | 439/717 |

FOREIGN PATENT DOCUMENTS

| | | | |
|---|---|---|---|
| 60-42276 | 3/1985 | Japan | H01R 13/50 |

*Primary Examiner*—Steven L. Stephan
*Assistant Examiner*—Eugene G. Byrd
*Attorney, Agent, or Firm*—Sughrue, Mion, Zinn Macpeak & Seas, PLLC

[57] ABSTRACT

A multi-stage connector in which a plural number of housings 25 and 29 are molded from resin in a state in which the housings 25 and 29 are stacked on each other so that opening portions 37 of the housings 25 and 29 face in opposite directions to each other and in which side portions of the housings 25 and 29 are connected to each other by a band portion 27 which will be removed later when the housings 25 and 29 are assembled. The band portion 27 connects the housings 25 and 29 to each other so that the opening portions 37 of the housings 25 and 29 face the same direction when the housings 25 and 29 molded from resin are arranged in line in one plane while connected to each other by the band portion 27. After solderless-contact terminals and coated wires are installed, the band portion 27 is removed, and the housings are connected to each other while stacked on each other so that the opening portion 37 of one housing is covered with a surface of an adjacent housing corresponding to the side opposite to its opening portion.

10 Claims, 9 Drawing Sheets

MULTI-STAGE CONNECTOR AND METHOD FOR PRODUCING AND ASSEMBLING THE SAME

BACKGROUND OF THE INVENTION

1. Field of the Invention

The present invention relates to a multi-stage connector comprising a plurality of substantially identical housings each having an opening portion formed in one surface of the housing, and terminal receiving chambers exposed to the outside through the opening portion, the housings being connected to one another so that the opening portion of one housing is covered by a surface of an adjacent housing corresponding to the side opposite to the opening portion of the one housing, and a method for producing and assembling the same.

2. Related Art

An example of a conventional multi-stage connector having a plurality of housings stacked on one another and connected to one another is disclosed, for example, in U.S. Pat. No. 4,629,279. As shown in FIGS. 10 and 11, which are a front view and a plan view of the connector, respectively, a first housing 1 and a second housing 3 are integrally molded while connected to each other by hinge portions 5. In FIG. 10, the housings 1 and 3 are provided with terminal receiving chambers 11 and 13 which have opening portions 7 and 9 formed above the terminal receiving chamber 11 and 13. Solderless-contact terminals 15 and 17 are received in the terminal receiving chambers 11 and 13, respectively.

As shown in FIG. 10, coated wires 19 are solderlessly forced, by a solderless-contact jig 21, into the solderless-contact terminals 15 received in the first housing 1. Further, coated wires 19 are solderlessly forced into the solderless-contact terminals 17 of the second housing 3 in the same manner as described above. After that, for example, the second housing 3 is turned around a hinge 5 in the direction of the arrow P in FIG. 10, so that the housings 1 and 3 are stacked on each other to thereby form such a male connector as shown in FIG. 12. FIG. 13 is a perspective view showing the male connector integrally molded with the first and second housings 1 and 3 and a female connector 23 to which the male connector is fitted.

The conventional multi-stage connector is, however, molded such that the opening portions 7 and 9 of the first and second housings 1 and 3 face in the same direction, as shown in FIGS. 10 and 11. Although this is an advantage in that solderless-contact terminals and coated wires can be installed easily from the same direction, because the housings 1 and 3 are molded side by side, the size of the mold is necessarily large. This increased size makes it difficult to mold large numbers of multi-stage connectors each having a plurality of housings (for example, two housings here) in a single mold.

Further, in the conventional multi-stage connector, the opening portions 7 and 9 face each other when the first and second housings 1 and 3 are stacked and connected to each other. Accordingly, the solderless-contact terminals 15 and 17 received in the terminal receiving chambers 11 and 13 face each other reversed in the vertical direction. It is therefore necessary to install terminals of a partner female connector 23 taking into account the directions of the terminals; or the partner housings must be designed so that the terminals of the partner housings face each other reversed in the vertical direction. Thus, a problem arises in that much labor is required for assembling and producing the multi-stage connector.

SUMMARY OF THE INVENTION

Therefore, an object of the present invention is to provide a multi-stage connector in which the size of a mold for molding the multi-stage connector is not exceedingly large; terminal fittings and coated wires can be installed easily from the same direction with respect to a plurality of housings; and the terminal fittings in the plurality of housings after assembling face the same direction vertically.

In order to achieve the foregoing object, according to the present invention, a multi-stage connector is provided comprising a plurality of housings each having an opening portion formed in one surface of the housing, a second surface opposite the first surface, and terminal receiving chambers exposed to the outside through the opening portion, the housings being connected to one another so that the opening portion of one housing is covered by the second surface of an adjacent housing, wherein the plurality of housings are molded from a resin by one mold in a state in which the housings are stacked on one another so that the opening portions of adjacent housings face in opposite directions; side portions of adjacent housings are connected to each other by connection portions which are to be removed when the plurality of housings are assembled; and the connection portions connect the housings to one another so that the opening portions of the housings face the same direction when the housings are arranged in line in one and the same plane while connected to one another by the connection portions.

In the multi-stage connector of the present invention, the plurality of housings are molded while connected to one another by the connection portions and stacked on one another. Accordingly, not only can the management of parts after molding be performed easily, but also reduction in the size of the mold can be achieved. Further, when the plurality of housings molded from a resin are arranged in line in one and the same plane while connected to one another by the connection portions, the housings are connected to one another by the connection portions so that the opening portions face the same direction. Accordingly, terminal fittings and coated wires can be installed from the same direction, so that workability is improved. After the terminal fittings and the coated wires are set, the connection portions are removed and the housings are connected to one another while stacked on one another so that the opening portion of one housing is covered with the second surface of an adjacent housing. Accordingly, the terminal fittings in the plurality of housings face the same direction after assembly.

DETAILED DESCRIPTION OF THE PREFERRED EMBODIMENTS

An embodiment of the present invention will be described below with reference to the drawings.

Figure 1:
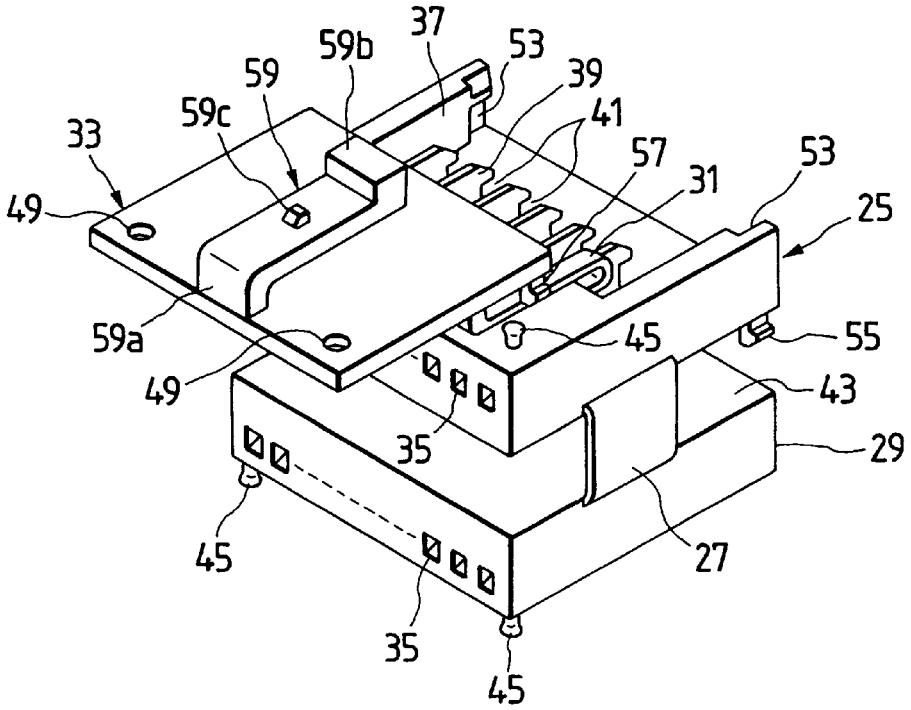
FIG. 1 is a perspective view showing a state in which a multi-stage connector according to an embodiment of the present invention is molded.
Figure 2:
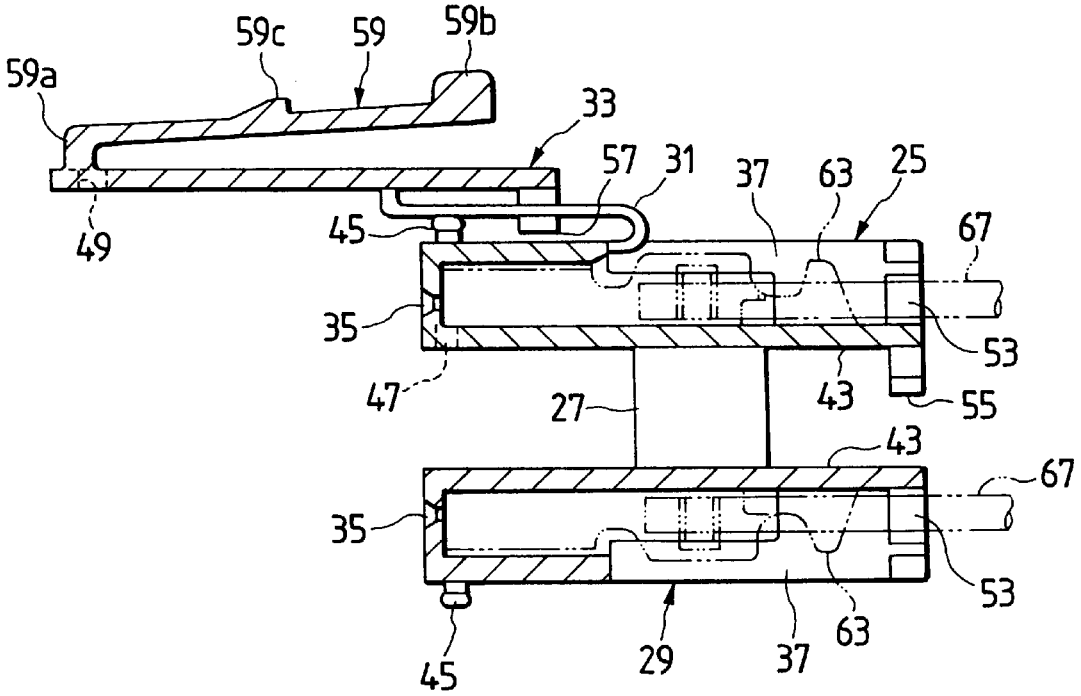
FIG. 2 is a side sectional view of the multi-stage connector in the state depicted in FIG. 1.

FIG. 1 is a perspective view showing the state in which a multi-stage connector according to an embodiment of the present invention is molded, and FIG. 2 is a side sectional view of the multi-stage connector. The multi-stage connector comprises: a first housing 25; a second housing 29 having the same structure as the first housing 25 and connected to the first housing 25 by means of a band portion 27 acting as a connection portion; and a cover 33 connected to the first housing 25 by a pair of hinge portions 31. These constituent parts are integrally molded in the state shown in FIG. 1.

Insertion holes 35 into which male terminals of a partner female connector are to be inserted are formed in the front end surface of each of the first and second housings 25 and 29. An opening portion 37 is formed in one surface of each of the first and second housings 25 and 29 on the connector-rear-side. By the provision of the opening portion 37, a plurality of terminal receiving chambers 41 formed by partition walls 39 in each of the first and second housings 25 and 29 are exposed to the outside.

As shown in FIG. 1, the first and second housings 25 and 29 are formed so that the respective opening portions 37 of the housings 25 and 29 face in opposite directions to each other and the respective back surfaces 43 of the housings 25 and 29 face each other. In this state, the housings 25 and 29 are connected to each other by means of the band portion 27 provided in the nearly lengthwise center portion on a back surface 43 side corner portion. When the first and second housings 25 and 29 are fitted to each other, the band portion 27 is cut off.

The cover 33 is located in the frontal side of the connector slightly offset from the opening portion 37 of the first housing 25. The lower surface portions of the cover 33 at its widthwise opposite ends are connected by hinge portions 31 to the connector-front-side opening edge portions of the opening portion 37 of the first housing 25.

Engagement protrusions 45 are formed in the widthwise opposite sides of the connector-front-side upper surfaces (that is, in the surface where the opening portions 37 are formed) of the first and second housings 25 and 29. Engagement holes 47 (see FIG. 2) to be engaged with the engagement protrusions 45 of the second housing 29 are formed in the back surface 43 of the first housing 25 corresponding to the engagement protrusions 45. Further, engagement holes 49 to be engaged with the engagement protrusions 45 of the first housing 25 are formed in the connector-front-side widthwise opposite ends of the cover 33.

Engagement concave portions 53 are formed in the rear upper-portions of side walls in the opening portions 37 of the first and second housings 25 and 29. Engagement claws 55 to be engaged with the engagement concave portions 53 of the second housing 29 are formed on the back surface 43 of the first housing 25 corresponding to the engagement concave portions 53. Engagement claws 57 to be engaged with the engagement concave portions 53 of the first housing 25 are formed on the connector-rear-side widthwise opposite ends of the cover 33.

A lock piece 59 for locking the partner female connector is provided in the widthwise center portion of the cover 33. The lock piece 59 is connected to the body of the cover 33 by a connection portion 59*a* between the engagement holes 49. A pressing operation portion 59*b* in the forward end side of the lock piece 59 can be elastically deformed so as to be moved vertically with the connection portion 59*a* as a fulcrum. The male connector is engaged with the partner female connector by a lock claw 59*c* provided in the center portion of the upper surface of the lock piece 59.

Figure 3:
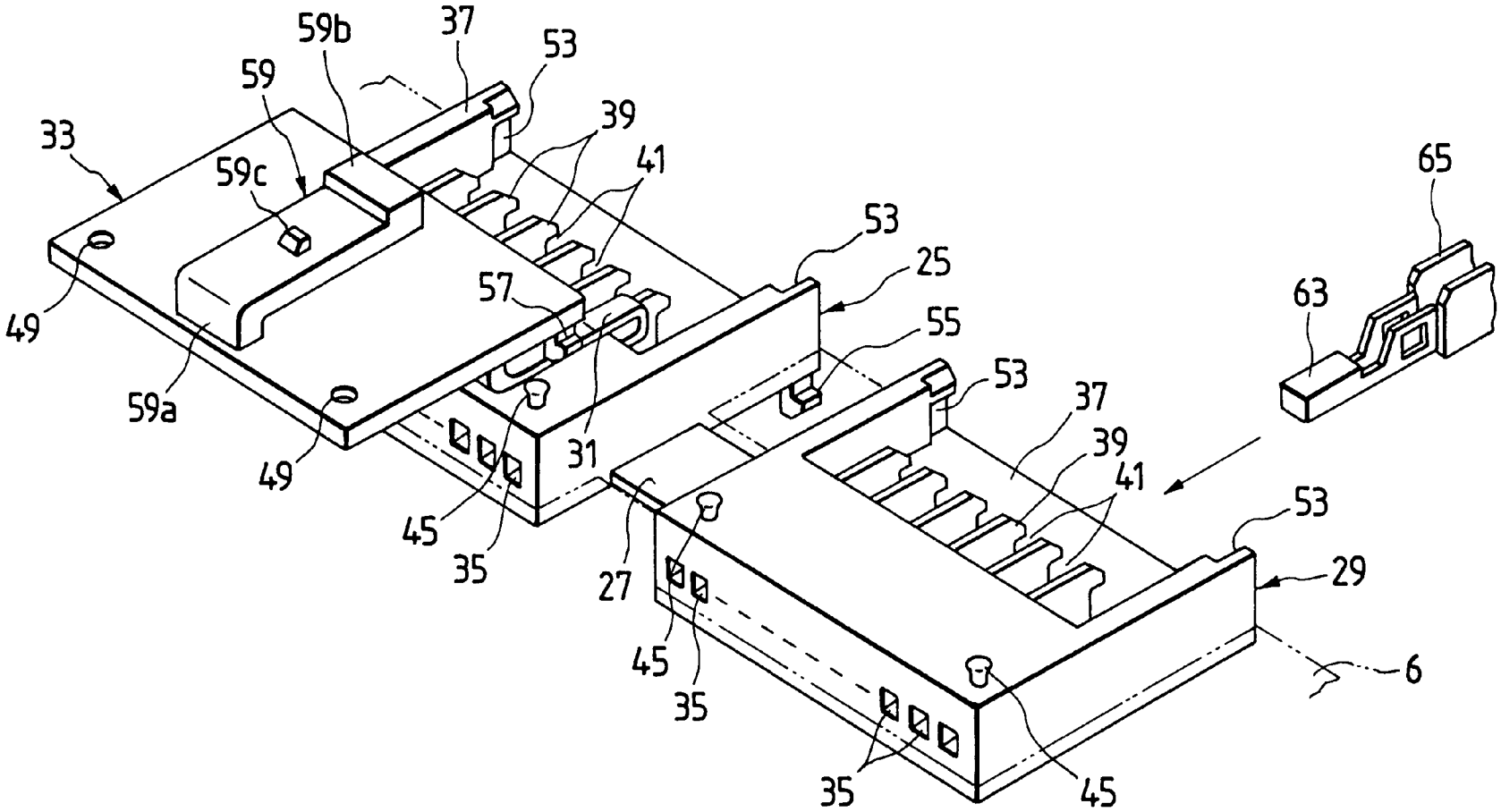
FIG. 3 is a perspective view showing a process of installing solderless-contact terminals in the multi-stage connector depicted in FIG. 1.

The multi-stage connector formed as shown in FIG. 1 is put on a receiving jig 61 in a state in which the band portion 27 is bent so that the second housing 29 is turned upside down so as to arrange the opening portion 37 of the second housing 29 in the same direction as the opening portion 37 of the first housing 25, as shown in FIG. 3. In this state, solderless-contact terminals 63 as terminal fittings are held by a chuck 65 and received in the terminal receiving chambers 41 of the housings 25 and 29 from the rear side of the connector.

Figure 4:
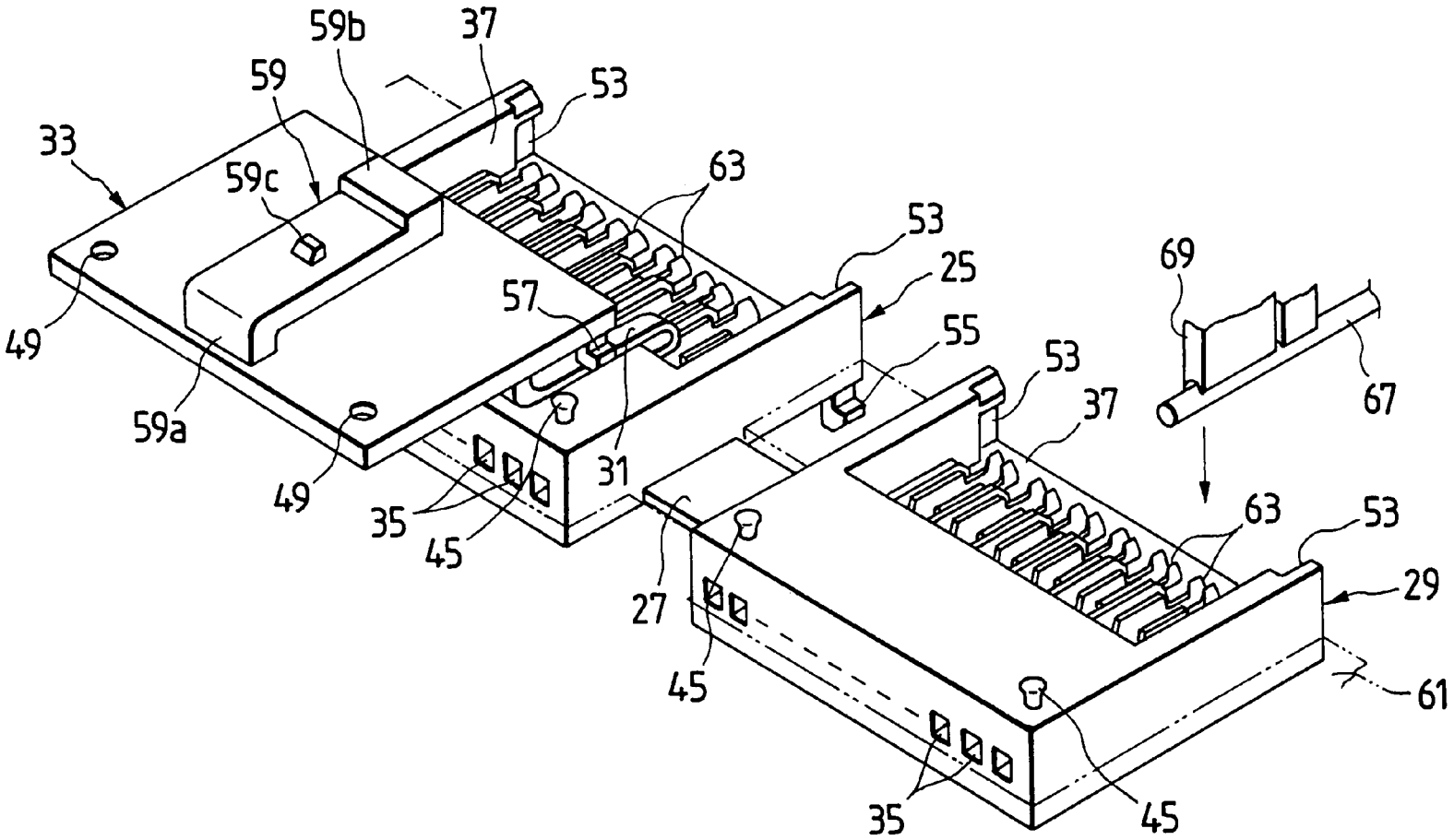
FIG. 4 is a perspective view showing a process of solderlessly fitting a coated wire to one of the solderless-contact terminals installed in the multi-stage connector depicted in FIG. 3.

As shown in FIG. 4, a coated wire 67 is then solderlessly forced into each of the solderless-contact terminals 63 in the terminal receiving chambers 41 by a crimper 69 as a solderless-contact jig, and the coating of the coated wire 67 is cut by solderless-contact blades in the solderless-contact terminal 63 to bring the solderless-contact blades into contact with the inside core wire of the coated wire to thereby electrically connect the solderless-contact blades to the core wire.

The solderless-contact terminals 63 and the coated wires 67 are installed through the opening portions 37 which are opened in the same direction with respect to the first and second housings 25 and 29. Thus, the installation process is easy.

Figure 5:
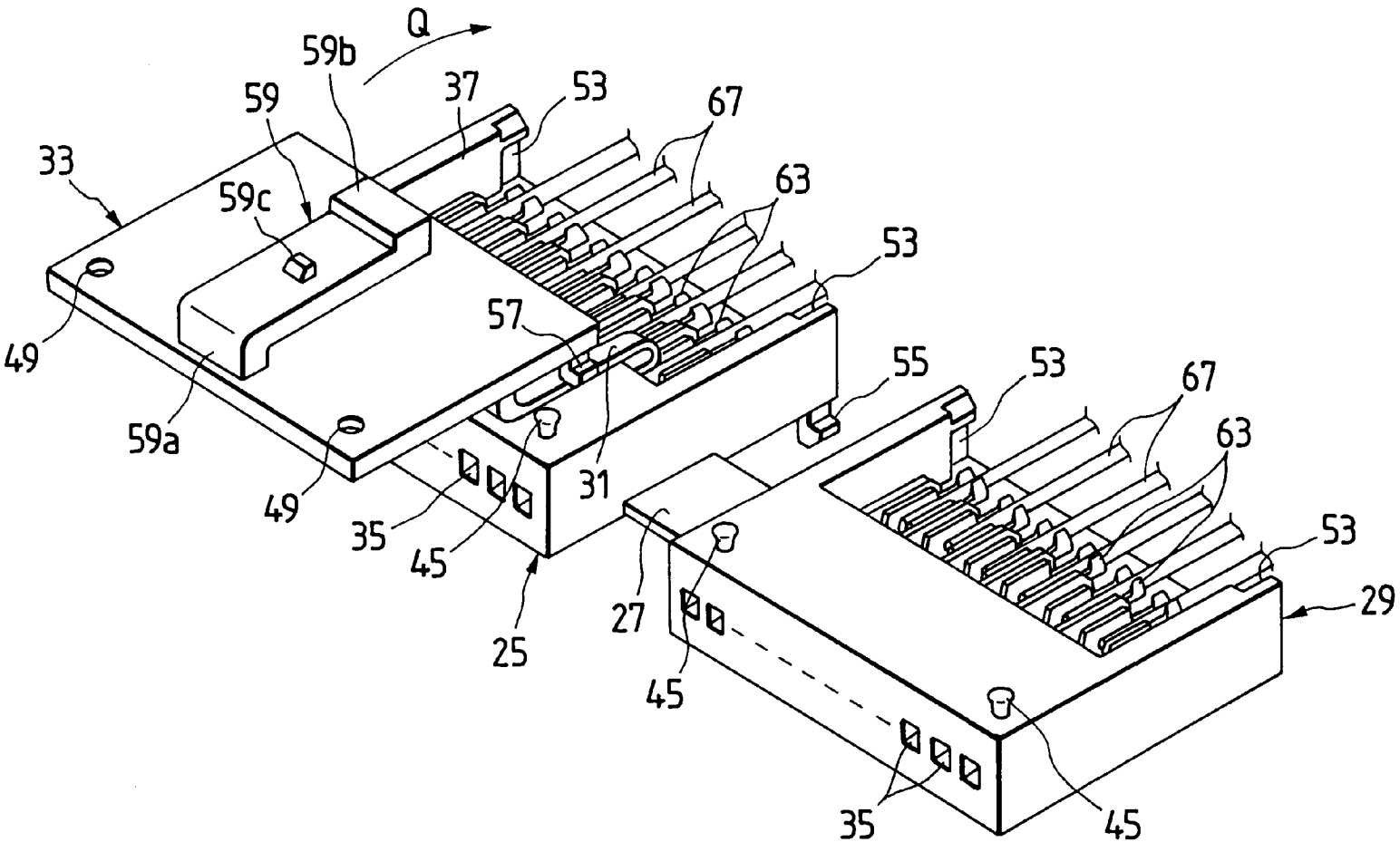
FIG. 5 is a perspective view showing the inventive connector when the solderless fitting process depicted in FIG. 4 is completed.
Figure 6:
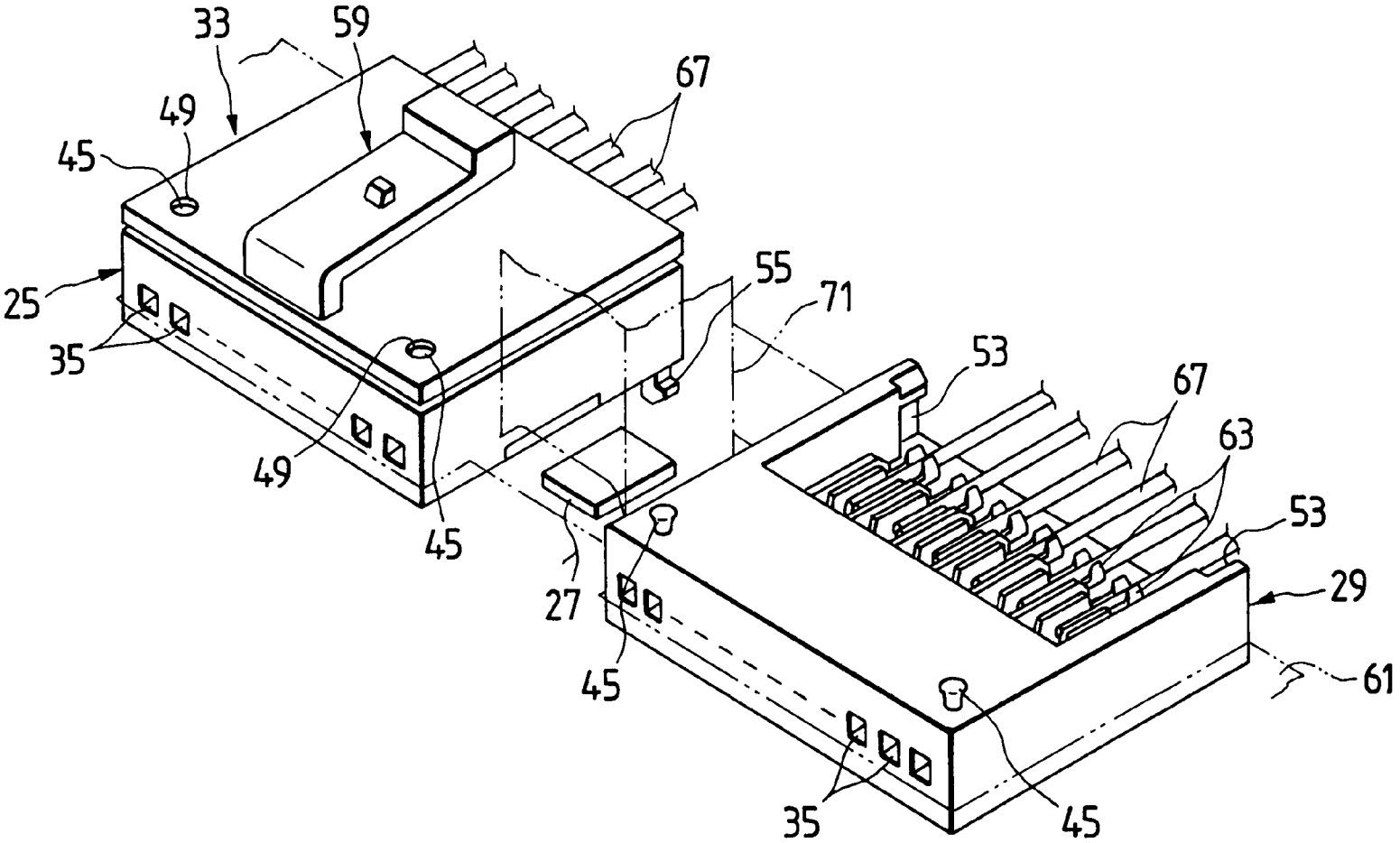
FIG. 6 is a perspective view showing a process of cutting a band portion while attaching a cover to the multi-stage connector in the state depicted in FIG. 5.

FIG. 5 shows the connector when the process of solderlessly connecting the coated wires 67 to the solderless-contact terminals 63 in FIG. 4 is completed. From this state, the cover 33 is moved via the hinge portions 31 in the direction of the arrow Q to close the opening portion 37 of the first housing 25 so that the cover 33 is put on the first housing 25 as shown in FIG. 6. At this time, not only the engagement protrusions 45 of the first housing 25 are engaged with the engagement holes 49 of the cover 33, but also the engagement claws 57 of the cover 33 are engaged with the engagement concave portions 53 of the first housing 25, so that the first housing 25 and the cover 33 are fixed to each other.

The band portion 27 is then cut by a band cutting crimper 71 shown in FIG. 6 in the vicinity of the connection portion between the first and second housings 25 and 29, so that the housings 25 and 29 are separated from each other.

The housings 25 and 29 thus separated from each other are then connected to and assembled with each other while the first housing 25 having its opening portion 37 facing upward is aligned with the second housing 29 having its opening portion 37 facing upward in the same direction as shown in FIG. 5, so that the opening portion 37 of the second housing 29 is covered with the back surface 43 of the first housing 25. At this time, not only are the engagement protrusions 45 of the second housing 29 engaged with the engagement holes 47 of the first housing 25, but also the engagement claws 55 of the first housing 25 are engaged with the engagement concave portions 53 of the second housing 29, so that the first and second housings 25 and 29 are fixed to each other. Thus, the male multi-stage connector comprising the first and second housings 25 and 29 and the cover 33 is completely assembled as shown in FIG. 7.

Figure 7:
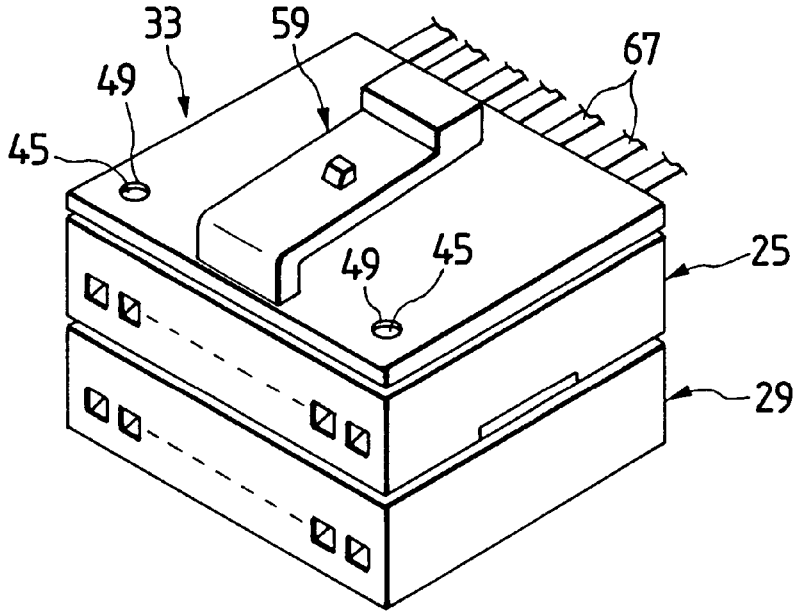
FIG. 7 is a perspective view showing a state in which the housings in FIG. 6 are stacked and connected to each other.
Figure 8:
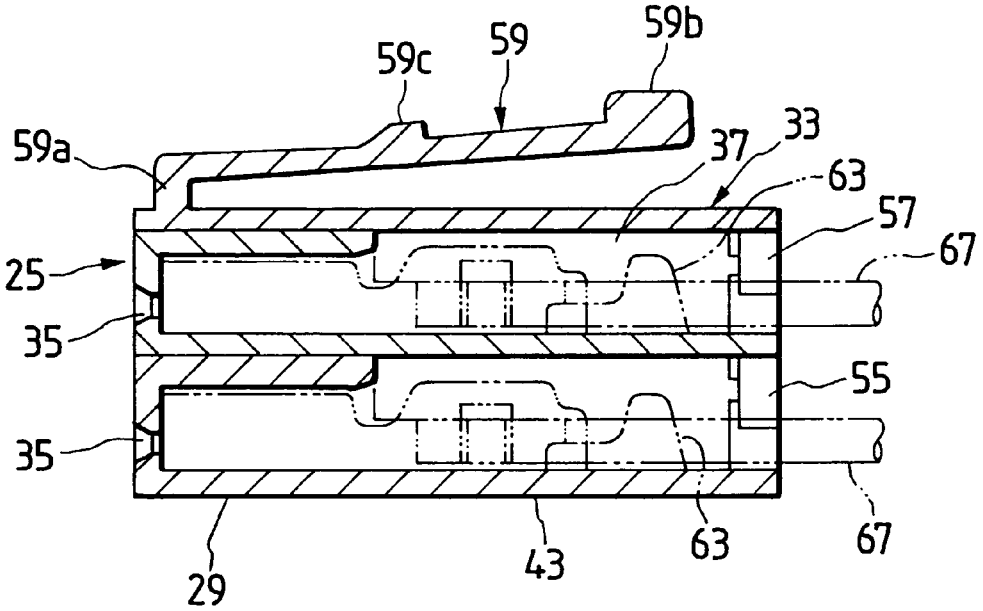
FIG. 8 is a side sectional view of the multi-stage connector depicted in FIG. 7.

FIG. 8 is a side sectional view of multi-stage connector assembled as shown in FIG. 7. The solderless-contact terminals 63 in the first housing 25 are arranged in the same direction as the solderless-contact terminals 63 in the second housing 29. Accordingly, to fit the male multi-stage connector into the partner female multi-stage connector not shown, terminals of the partner multi-stage connector can be also arranged in one predetermined direction. Accordingly, the partner connector is easy to assemble and produce.

Further, because the multi-stage connector is molded in such a manner that the first and second housings 25 and 29 are connected to each other by the band portion 27 as shown in FIG. 1, parts can be easily managed. Further, because the multi-stage connector is molded in a state in which the housings 25 and 29 are stacked on each other, the size of the mold required for molding the multi-stage connector is reduced so that moldability is improved.

Although an embodiment of the invention has been described above where the multi-stage connector includes two housings, the invention can be applied to the case where the multi-stage connector is molded such that three or more housings are successively connected to one another by band portions so as to be stacked on one another.

Figure 9A:
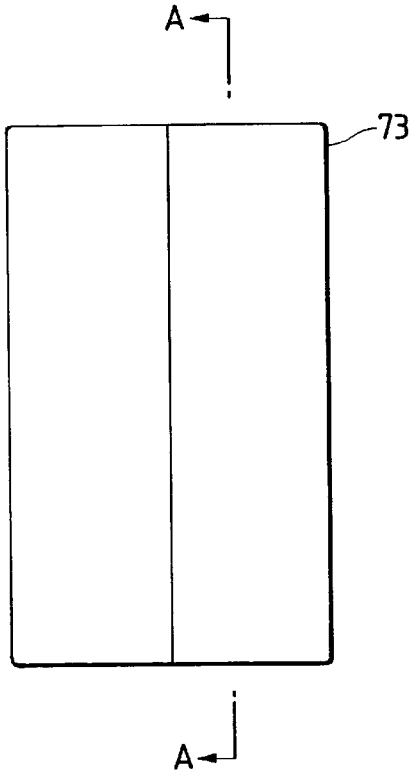
FIG. 9A is a side view showing a mold in which four multi-stage connectors each having three housings can be formed.
Figure 9B:
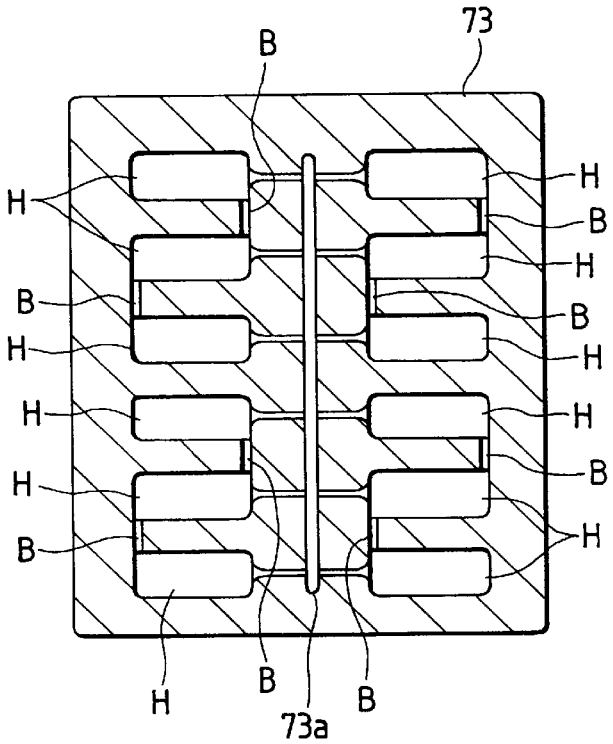
FIG. 9B is a sectional view taken along the line A—A in FIG. 9B.
Figure 10:
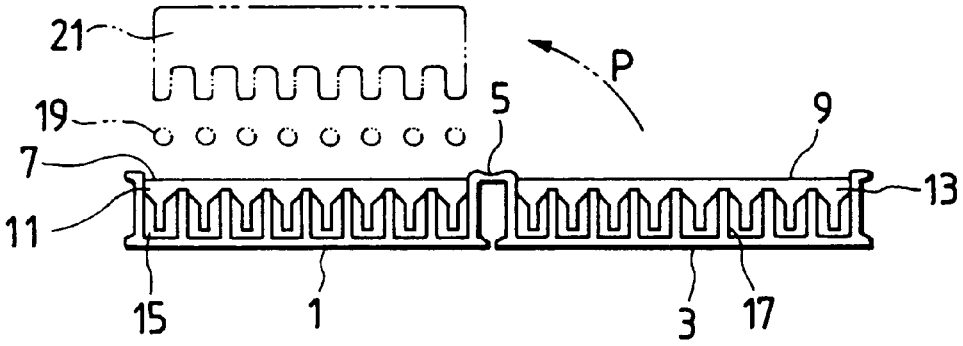
FIG. 10 PRIOR ART
FIG. 10 is a front view of a conventional multi-stage connector.
Figure 11:
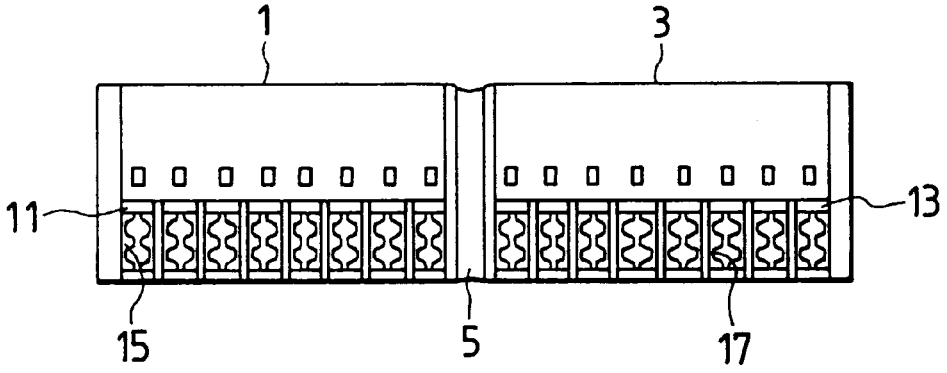
FIG. 11 PRIOR ART
FIG. 11 is a plan view of the conventional multi-stage connector depicted in FIG. 10.
Figure 12:
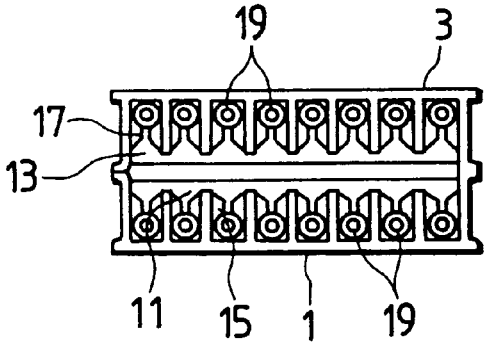
FIG. 12 PRIOR ART
FIG. 12 is a front view showing a state in which two housings of the multi-stage connector depicted in FIG. 10 are stacked on each other.
Figure 13:
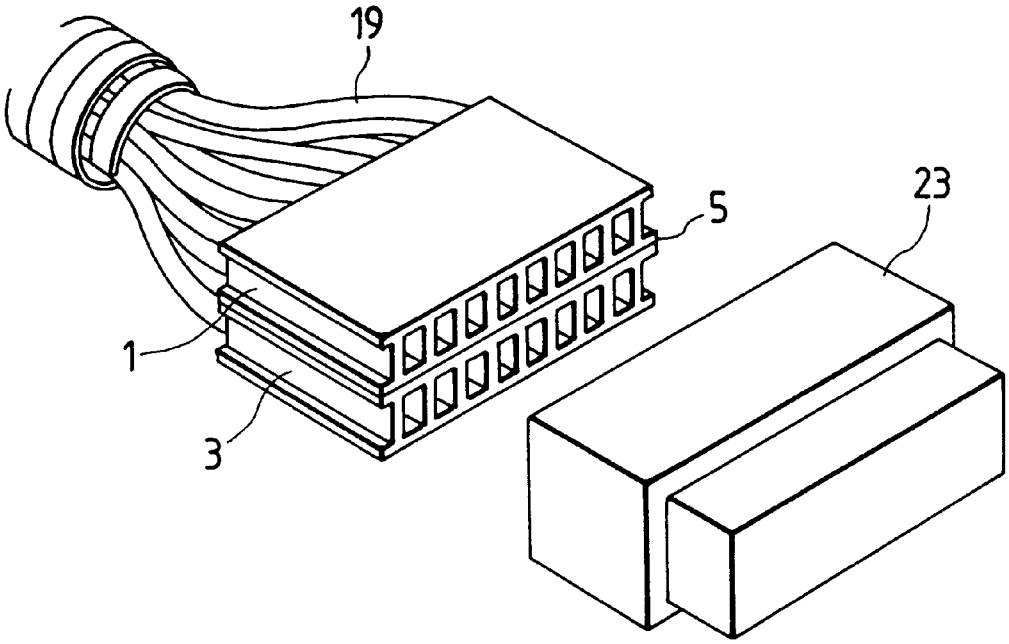
FIG. 13 PRIOR ART
FIG. 13 is a perspective view showing an assembled conventional multi-stage connector depicted in FIG. 10, and a partner connector.

FIG. 9A is a side view of a mold 73 by which four multi-stage connectors, each having three housings H connected to one another by band portions B, are molded simultaneously. FIG. 9B is a sectional view taken along the line A—A in FIG. 9A. In FIGS. 9A and 9B, only the housings H are integrally molded by one mold but covers are molded by another mold. Molten resin is supplied to the mold cavities H, B through a runner portion 73*a* provided in the center of the mold 73.

Also, in this case where three housings H are molded so as to be stacked on one another, with respect to each of the four simultaneously molded connectors, opening portions in which terminal receiving chambers of the three housings H are exposed to the outside are alternately arranged so that adjacent housings are inverted with respect to each other as shown in FIG. 9B. That is, the three opening portions are alternately arranged so that all opening portions face the same direction when the band portions B are bent after molding to arrange the three housings H in line on a receiving jig.

Also, in the example of FIGS. 9A and 9B, the opening portions on the receiving jig face the same direction. Accordingly, the solderless-contact terminals and the coated wires are easy to install. After their installation, the band portions B are cut off by a band cutting crimper, and the housings H are connected to and assembled to one another so that the opening portions face the same direction.

If multi-stage connectors each having three housings H as described above are molded side by side in one and the same plane as shown in the prior art, it is difficult to obtain plural numbers of parts at the same time, for example, it is impossible to mold four moldings by one mold as shown in FIGS. 9A and 9B, because the size of the mold becomes considerably large. Accordingly, the cost of production cannot be reduced sufficiently. If multi-stage connectors each having three housings H are, however, molded such that the three housings H are stacked on one another as shown in FIG. 9B, the mold can be reduced in size, the number of parts molded by one mold can be increased, and the cost of production can be reduced.

As described above, according to the present invention, a plurality of housings are molded by one mold such that the housings are connected to and stacked on one another by connection portions which will be removed later during assembly. Accordingly, not only is management of parts after molding performed easily, but also a reduction in the size of the mold is achieved. Further, when the plurality of housings are arranged in line, after molding, in one and the same plane while connected to one another by the connection portions, the opening portions of the housings face the same direction. Thus, terminal fittings and coated wires can be installed from one and the same direction, so workability is improved. Further, after assembly, the terminal fittings in the housings face the same direction. Thus, the terminals of a partner connector can also be arranged in one predetermined direction, so that the partner connector can be assembled and produced easily.

Although the present invention has been described by way of the preferred embodiments thereof with reference to the accompanying drawings, various changes and modifications will be apparent to those skilled in the art. Therefore, unless these changes and modifications otherwise depart from the scope of the present invention, they should be construed as included therein.

What is claimed is:

1. A multi-stage connector comprising:

a plurality of housings, each having an opening portion formed in a first surface of said housing, a second surface opposite said first surface, a pair of side portions, and terminal receiving chambers exposed to the outside through said opening portion, said housings engagable with one another so that said opening portion of one of said housings is covered by said second surface of another of said housings; and a connection portion which connects one of said side portions of each of a pair of adjacent said housings to each other;

wherein said plurality of housings are stackable on one another prior to engagement with each other so that the opening portions of adjacent ones of said housings face in opposite directions to each other, said connection portion is removable when said plurality of housings are engaged, and said connection portion connects said housings to one another so that the opening portion of each of said housings face the same direction when the housings are arranged in line in one and the same plane while connected to one another by the connection portions.

2. A multi-stage connector according to claim 1, wherein said plurality of housings and said connection portion are molded of resin and are continuous with one another.

3. A multi-stage connector according to claim 1, further comprising a cover integrally molded together with one of said housings, and a hinge portion connecting said cover and said one of said housings, so that said opening portion of said one of said housings is coverable by said cover when said plurality of housings are connected to one another.

4. A multi-stage connector according to claim 1, wherein said connection portion comprises a band portion disposed at a junction between said second surface and one of said side portions of each of said pair of adjacent said housings.

5. A multi-stage connector according to claim 3, wherein said plurality of housings each further comprises engagement protrusions on said first surface and engagement holes on said second surface, said engagement protrusions of one of said housings being engageable with said engagement holes of an adjacent one of said housings for alignment of said housings with each other.

6. A multi-stage connector according to claim 5, wherein said plurality of housings each further comprises concave portions in side walls of said opening portions, and claws disposed on said second surface, said concave portions of one of said housings being engageable with said claws of an adjacent one of said housings for securing said housings together.

7. A multi-stage connector according to claim 6, wherein said cover comprises engagement holes engageable with said engagement protrusions and claws engageable with said concave portions for securing said cover to one of said housings.

8. A multi-stage connector according to claim 3, wherein said cover comprises a lock piece for locking said connector to a partner connector.

9. A method for producing and assembling a multi-stage connector comprising a plurality of housings each having an opening portion formed in one surface of said housing, a second surface opposite said first surface, and terminal receiving chambers exposed to the outside through said opening portion, said housings being engageable with one another so that said opening portion of one housing is covered with said second surface of an adjacent housing, wherein said method comprises the steps of:

molding said plurality of housings from resin such that said housings are stacked on one another so that the opening portions of adjacent housings face in opposite directions to each other, and one of said side portions of each of a pair of said adjacent housings are connected to each other by a connection portion which is removable when the housings are assembled, said connection portion connecting said adjacent housings to one another so that the openings of said adjacent housings face the same direction when said plurality of housings molded from resin are arranged in line in one and the same plane while connected to one another by said connection portion;

arranging said housings in line in one and the same plane while connected to one another by said connection portion after resin molding so that said openings of said housings face the same direction;

installing terminal fittings in said opening portions;

installing coated wires into said terminal fittings;

removing said connection portion; and stacking said housings on one another and engaging said housings to one another such that said openings of said housings face one and the same direction.

10. A method for producing and assembling a multi-stage connector according to claim 9, further comprising the step of molding one of said housings together with a cover and a hinge portion connecting said cover to said one of said housings, so that said opening portion of said one of said housings is coverable by said cover when said plurality of housings are connected to one another.

* * * * *